US005515651A

United States Patent [19]

Hofmann et al.

[11] Patent Number: 5,515,651

[45] Date of Patent: May 14, 1996

[54] DEVICE FOR FASTENING A WINDOW OF A MOTOR VEHICLE IN THE GUIDE DEVICE OF A WINDOW LIFTER

[75] Inventors: Gerhard Hofmann, Ansbach; Bernd Münekhoff, Ebersdorf; Georg Scheck, Weitramsdorf; Carsten Brandt, Weidach; Adrian Geiger; Erik Langmann, both of Coburg, all of Germany

[73] Assignee: Brose Fahrzeugteile GmbH & Co. KG, Coburg, Germany

[21] Appl. No.: 498,063

[22] Filed: Jul. 5, 1995

Related U.S. Application Data

[63] Continuation-in-part of Ser. No. 278,540, Jul. 19, 1994, abandoned.

[30] Foreign Application Priority Data

Aug. 2, 1993 [DE] Germany ..... 43 25 917.0
Jul. 5, 1994 [DE] Germany ..... 44 23 440.6

[51] Int. Cl.[6] ..... E05F 11/38

[52] U.S. Cl. ..... 49/375

[58] Field of Search ..... 49/375, 376, 374, 49/351, 352

[56] References Cited

U.S. PATENT DOCUMENTS 4,663,901 5/1987 Ichinohe ..... 49/375 X
4,991,351 2/1991 Bertolini ..... 49/375 X
5,065,545 11/1991 Kane et al. ..... 49/375

FOREIGN PATENT DOCUMENTS 0208237 1/1987 European Pat. Off. .
201098 7/1983 Germany .
327295 2/1985 Germany .

*Primary Examiner*—Philip C. Kannan
*Attorney, Agent, or Firm*—Christie, Parker & Hale

[57] ABSTRACT

The invention relates to a device for fastening a window of a motor vehicle in the guide device of a window lifter, consisting of retaining legs disposed on opposite sides of the lower area of the window, at least one of said retaining legs having an opening which can be engaged by a connecting element for retaining the window, wherein at least one upper part of at least one retaining leg is embodied to be resilient and supports an insertion section oriented in the direction of the lower edge of the window and essentially extending parallel with it. One feature of the invention is that the opening can comprise two cutouts, instead of one, in order to reduce the number of variations of catches required for use with window lifters. Another feature of the invention is that a connecting element for retaining the window in the guide device of a window lifter is already connected with the window prior to the window's insertion into the gap between the retaining legs. In a fastened state, the connecting element engages the cutout(s) of the retaining leg(s). Bolts inserted in a hole of the window, elements glued to the window or elements formed out of the window itself are examples of connecting elements.

36 Claims, 6 Drawing Sheets

DEVICE FOR FASTENING A WINDOW OF A MOTOR VEHICLE IN THE GUIDE DEVICE OF A WINDOW LIFTER

CROSS REFERENCE TO RELATED APPLICATION

This is a continuation-in-part of U.S. patent application Ser. No. 08/278,540 filed Jul. 19, 1994, entitled "Device for Fastening a Window of a Motor Vehicle in the Guide Device of a Window Lifter", now abandoned.

FIELD OF THE INVENTION

The invention relates to a device for fastening a window of a window lifting system in the guide device of a window lifter, consisting of retaining legs disposed on both sides of the window, at least one of the retaining legs having a cutout to engage a connecting element of the window.

BACKGROUND OF THE INVENTION

A fastening device is disclosed in European Patent Publication EP 0 208 237 B1 which can be connected with the window in the manner of a clip. Starting at a base body connected with a guide device of a window lifter, so-called wings extend on both sides of the window surface, one of which (the support wing) has a backward oriented pin. At least the support wing, or the wings located opposite the support wing, are resilient so that the window can be inserted between the wings. To make the mounting operation easier, the pin is beveled. When arriving at the through hole in the window which is assigned to the pin, the pin, which is under spring compression, snaps into the through hole and in this way connects the guide device of the window lifter with the window.

It is disadvantageous that the device only permits relatively low pulling forces, because the pin tends to slide out of the through hole of the window under higher loads because of its seating on a resilient support wing or between resilient auxiliary wings. A further disadvantage resides in that it depends on the dexterity of the installer how rapidly the required match between the through hole and the pin is achieved. With mass assembly of motor vehicles this can lead to disruptions in the assembly flow.

It is furthermore necessary to adapt the position of the pin on the support wing very carefully to the distance of the window hole from the lower edge of the window.

SUMMARY OF THE INVENTION

A device is needed for fastening a window of a motor vehicle in the guide device of a window lifter which assures a simple and secure assembly of the window and resists high pulling forces. In addition, the fastening device is needed to allow a service friendly removal of the window.

In one embodiment of the present invention, the fastening device includes two parallel retaining legs positioned at a distance to allow a window to be inserted in between the retaining legs. One or both retaining legs having an opening in which connected elements of the window are inserted. The connecting element of the window engages the opening in the retaining leg(s) that are disposed on both sides of the window after the window has been inserted into the gap between the retaining legs.

In one embodiment of the present invention, the connecting element can be fixedly (non-removably) connected with the window, for example by gluing a suitable part on the window surface or by forming the connecting element out of the window material itself. In another embodiment, a bolt is used as a connecting element and is inserted into a through hole in the window. The bolt is securely seated in the window hole by using stays, for example. Alternatively, the connecting element can be secured to the window by gluing the connecting element to the window or by molding the connecting element as part of the window.

In accordance with a preferred embodiment of the invention, the connecting element, such as the bolt, locks into the cutout of a retaining leg or of a pair of retaining legs, wherein a clip or a pair of clips, which are resilient in a direction vertically to the window surface, then grasp the connecting element.

The retaining legs of the fastening device, which are preferably made of plastic, have the clip described above as an integral component of the retaining legs that is positioned above the cutout for the connecting element. In the course of inserting the window, the clip, which is resiliently pivotable around an axis, can yield to the connecting element sliding by it. The clip and its area grasping the connecting element are embodied such that no outwardly oriented pivot movement can occur when a pulling force is applied. In this way the maximum pulling forces are exclusively determined by the mechanical load capacity of the fastening device.

The lower portion of the retaining leg is preferably essentially rigid and, if required, provided with support ribs in order to prevent undesirable bending.

In another embodiment of the present invention, the retaining legs provide insertion sections for the window at their ends and conical guide surfaces for the horizontal guidance of the connecting element. The conical guide is fastened on the side of the retaining leg facing the window and tapers in the direction of the cutout and finally makes a transition into the cutout itself.

Although for reasons of stability the use of connecting elements disposed on both sides of the window surface, for example by means of a bolt projecting on both sides over the through hole of a window, is advantageous, there is also the possibility of fastening on only one side.

If there is a requirement that tolerances are to be compensated for or adjustments provided, the cutouts in the retaining legs can be horizontally or vertically oriented oblong hole guides which are complemented with retainers for adjustment as needed in each case.

A further preferred embodiment of the invention uses retaining legs with two cutouts disposed next to each other, of which one cutout is customarily embodied as a circular hole and the other as an elongated hole. The elongated hole essentially extends transversely to the path of the window. A common resilient clip extends over both cutouts and the cutouts are connected with each other via a gap. This embodiment reduces in half the number of variations of catches otherwise required for use with window lifters in the right or left door.

In the prior art, four different variants of catches (for driver and passenger doors, respectively, one catch near the forward pillar of the car adjacent the sideview mirror, commonly known in the art as the A pillar, and one catch near the next pillar closer to the rear of the car located right after the respective door, commonly known in the art as the B pillar) were required for a dual-strand cable window lifter or a cross-arm window lifter.

Two catch variants suffice for the present invention, right and left, whose mirror-reversed arrangement of the circular hole and the elongated hole allow the use of each respective catch at two locations (once in the right door and once in the left door).

In an advantageous manner, the fastening device of the invention and the guide device of the window lifter such as a catch are provided in one piece.

The invention will be explained in detail below by means of exemplary embodiments illustrated in the drawings.

DETAILED DESCRIPTION OF THE PREFERRED EMBODIMENT

Figure 1:
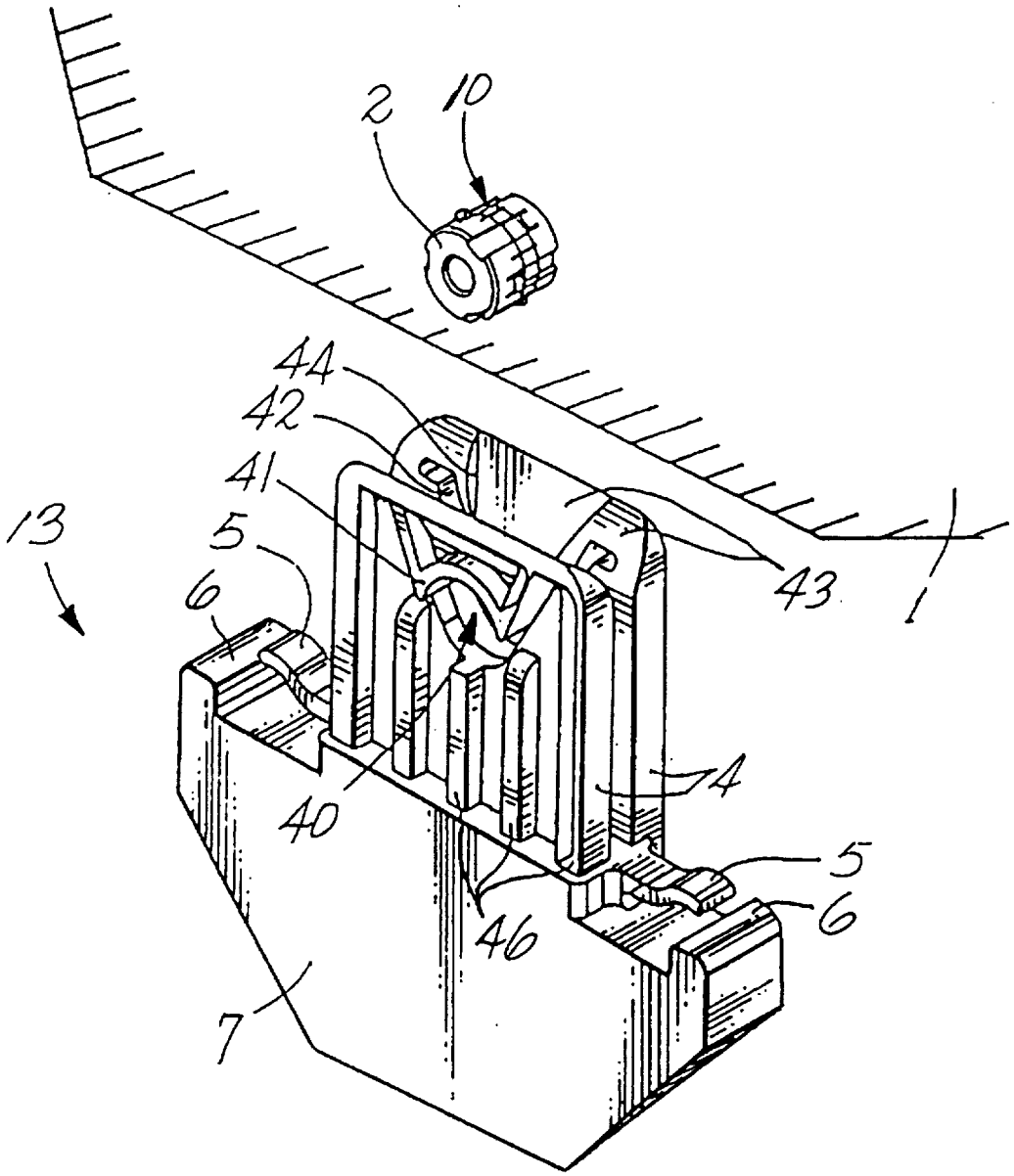
FIG. 1 is a perspective view of the fastening device with an integrated catch and a window with a bolt-like connecting element disposed above it.

A fastening device in accordance with the invention for fastening a window in the guide device 7 of a window lifter, as disclosed in FIG. 1, is simple and at the same time safe to install. Referring to FIG. 1, special guide surfaces 43 and 44 compensate for inaccuracies occurring when window 1 and fastening device 13 approach each other. In addition, the design of retaining legs 4, and, in particular, of the clip area 41 and its support surface 402 (see FIG. 2), assures that high pulling forces are required for removal. There is no tendency of the connecting element 2 to slide out of the cutout 40, because the occurring pulling forces are unable to cause the opposite retaining legs 4 to bend open or a pivoting away of the clip area 41.

The exemplary embodiment of FIG. 1 shows a fastening device 13 formed in one-piece with a catch 7 and preferably molded of plastic. Alternatively, fastening device 13 and catch 7 are formed separately and connected thereafter. The connecting element 2 is positioned in the through hole 10 of the window 1 and is coupled to fastening device 13. Parallel oriented retaining legs 4 arise over the catch 7, shown only schematically and without details. The distance between retaining legs 4 approximately corresponds to the thickness of the window 1. Insertion sections 43 are on the upper edge of one or both (as shown) of retaining legs 4 that are rounded or beveled and sloped down and in toward the area between the retaining legs 4 to ease the insertion of the window 1. A relatively high degree of rigidity is provided for the retaining legs 4 by the application of support ribs 46. However, a clip area 41 which is provided in the upper area is resilient and pivotable around an axis 45 and is not rigid as illustrated in FIG. 2.

Figure 2:
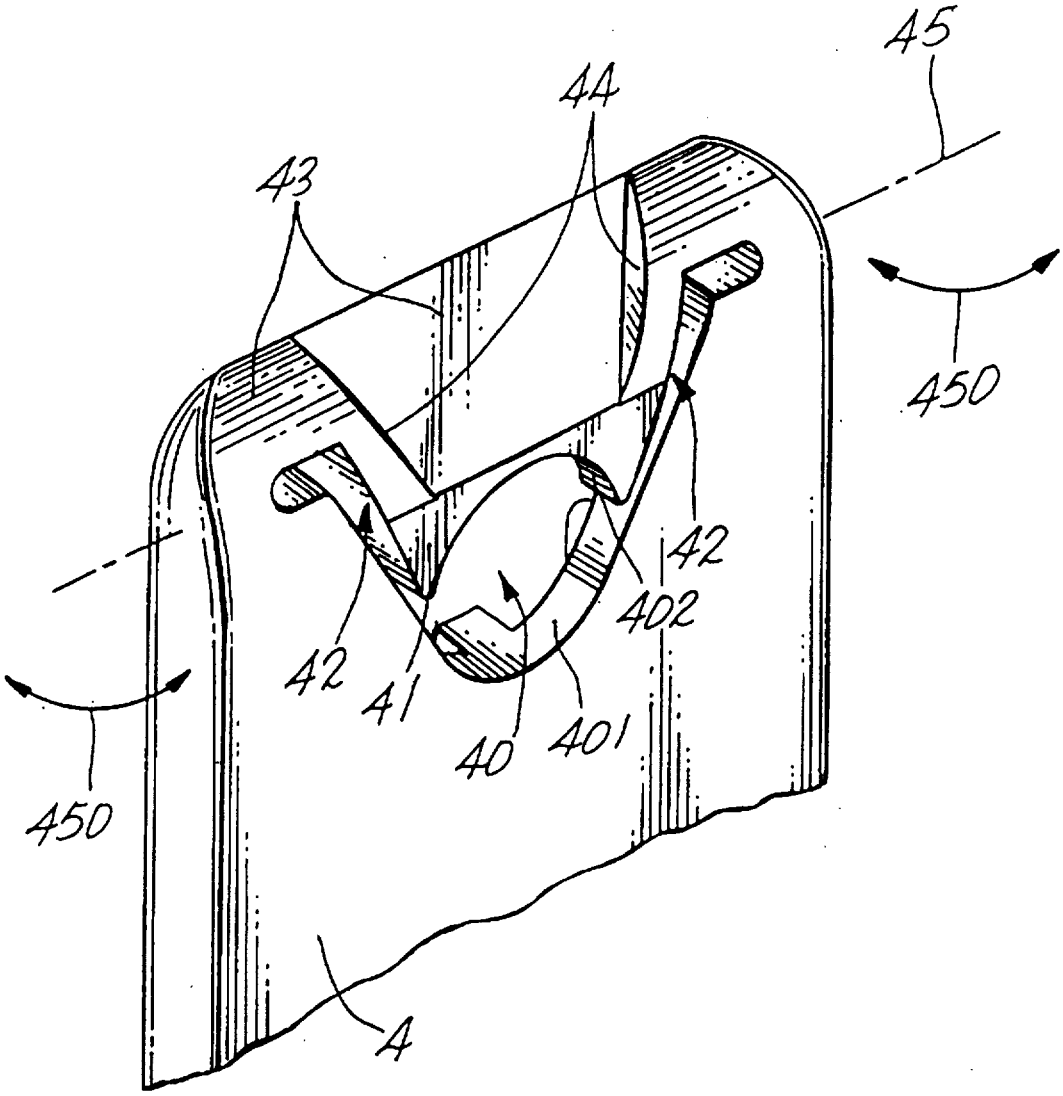
FIG. 2 is an enlarged perspective view of a retaining leg of the fastening device of FIG. 1 in a view of the inner surfaces of the retaining leg.

Referring to FIG. 2, slits 42 follow the cutout 40 and extend ray-like in the direction of the upper corners of the retaining leg 4, in the course of which the surfaces of the slits 42 make a direct transition into the upper or lower support surface 401 and 402, respectively, of the cutout 40. The end sections of the slits 42 are bent in the direction of the lateral edges of the retaining leg 4, and in the process cause a weakening of the material in such a way that when the clip 41 is stressed vertically in relation to the plane of the window, it yields in the one or the other pivot direction 450 around the pivot axis 45.

Besides the insertion section 43, which also extends to the clip area 41, the clip area 41 has a pair of surfaces 44 extending conically towards each other, spread out in the direction of the cutout 40 and finally end at a distance which approximately corresponds to the diameter of the cutout 40, where cutout 40 is circular. Alternatively, cutout 40 is not round. For example, where cutout 40 is oblong, the surfaces 44 spread out in the direction of the cutout 40 and end at a distance that approximates the width of the noncircular cutout.

Figure 3:
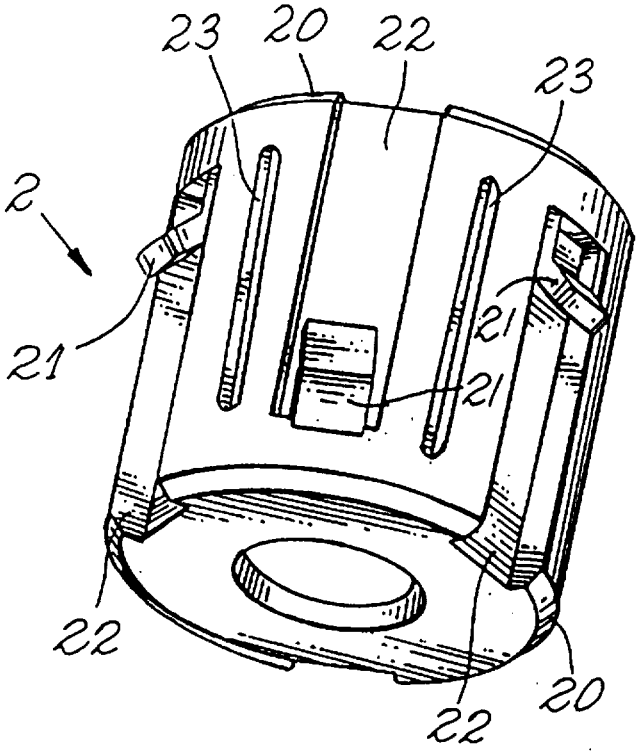
FIG. 3 is a perspective view of a connecting element which can be clipped into a through hole of a window.

FIG. 3 shows the bolt-like connecting element 2 with alternately disposed resilient loss-preventing means 21 which rise above the general circumference of the bolt at the end of the grooves 22. The grooves 22 are only used to remove the injection molding die. Axially oriented ribs 23 are disposed between the loss-preventing means 21 and are used as tolerance compensators in respect to the window through hole 10 and are relatively easily deformable. The ends or cover faces of the bolts are provided, for example, with a beveled insertion section 20 to facilitate insertion of the bolt. After the bolt is pressed in, the window 1 is seated between the loss-preventing means 21. Removal of the bolt for removing the window 1 can be performed by applying excess pressure to the loss preventing means by means of a suitable tool.

Figure 4:
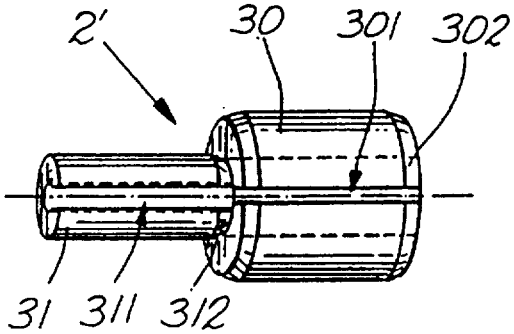
FIG. 4 is a perspective view of a connecting element which can be retained in the manner of a peg in the through hole of the window.

FIG. 4 shows, alternatively to connecting element 2, a connecting element 2' that consists of an outer bolt 30 that has a longitudinal slit 301 and an inner peg 31 which is inserted into a hollow center (not shown) in the bolt 30. The bolt 30 and the peg 31 can also be embodied as a one piece injection molded plastic part and connected with each other via a predetermined breaking line, not shown.

After the bolt 30 has been positioned in the window through hole 10, the peg 31 provided with a beveled insertion section 312, for example, is pressed into the axial opening of the bolt 30 and widens the slit 301. The slit 301 extends longitudinally along peg 31 and is intended to assure limited resilience for the peg 31, so that excess torsional forces need not be absorbed by the bolt 30 alone. This variant of connecting element 2, connecting element 2', is particularly suited for the compensation of especially large tolerances between the window through hole 10 and the bolt 30.

Figure 5:
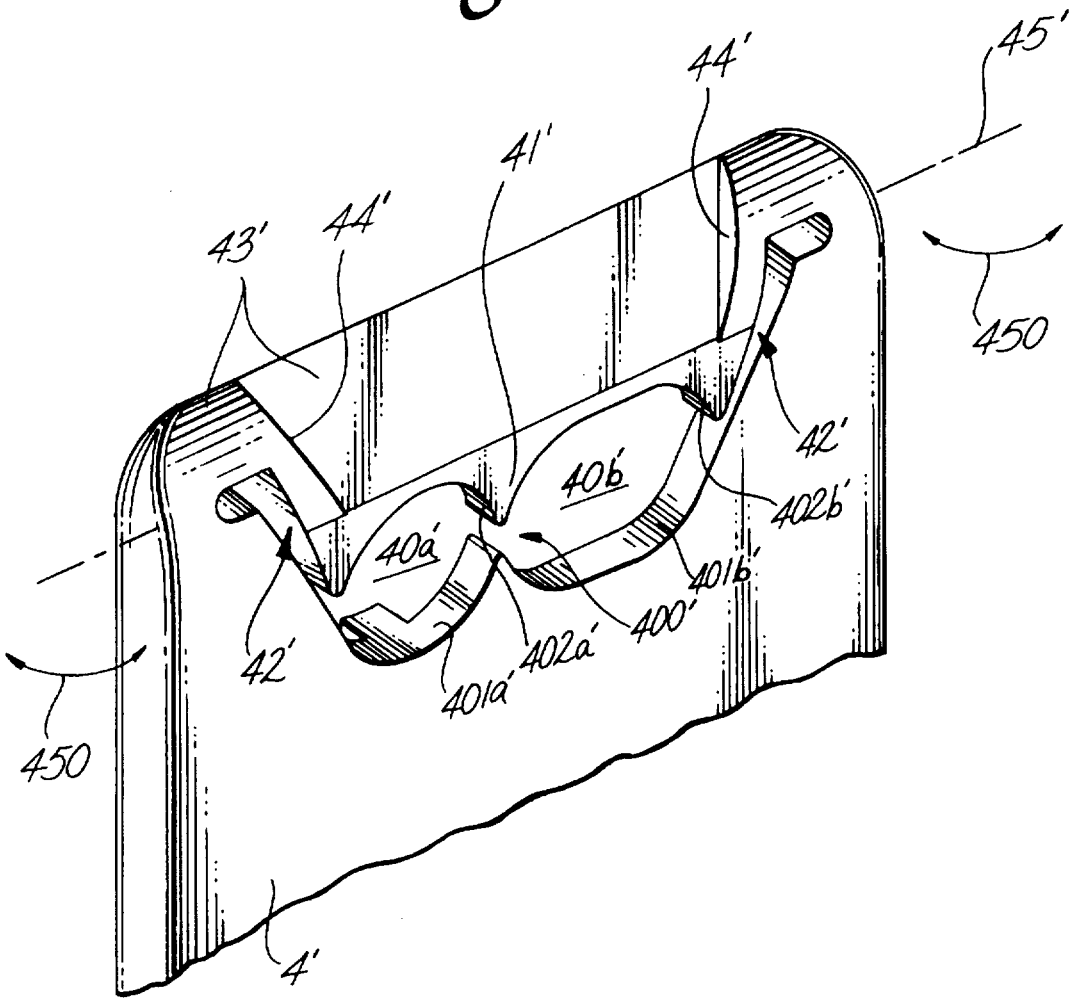
FIG. 5 is a perspective view of a modified retaining leg of the fastening device with a circular hole and an elongated hole.

The embodiment of the invention represented in FIG. 5 reduces the number of devices necessary for fastening a window and, therefore, reduces costs. It permits the use of one and the same catch in the right and the left doors. The retaining legs each represented schematically at 4' are similar to the retaining legs 4 of the catch 7 of FIG. 1 but each retaining leg 4' has two cutouts 40*a'*, 40*b'*, disposed next to each other, of which one cutout 40*b'* is an elongated hole for the purpose of compensating for tolerances, and the other cutout 40*a'* has a customary, essentially circular shape. A common resilient clip 41' borders the cutouts 40*a'*, 40*b'* at the top. The upper support surfaces 402*a'*, 402*b'* of the clip 41' together with the lower support surfaces 401*a'*, 401*b'* of the retaining leg 4' form the shape of the cutouts 40*a'*, 40*b'*. In the transition area from one cutout 40*a'* to the other cutout 40*b'*, the upper and lower support surfaces form a gap, so that the use of a common resilient clip is possible. This embodiment is further shown in FIG. 6 and corresponds to the left embodiment (identified by "l"). Furthermore, the right hand analog (identified by "r") is shown schematically in FIG. 6*a* where corresponding part numbers have been given additional primes. Therefore, for ease of reference during the following discussion a single ' designates parts of the left catch 7' with retaining legs 4' and a " designates parts of the right catch 7" with retaining legs 4".

Depending on whether the respective catch is to hold the associated connecting element, for example the bolt 2 seated in the window through-hole 10, rigid or is to allow movement in the direction of travel (i.e., the so-called X-direction) to compensate for tolerance, the connecting element is clipped into either the circular hole 40*a'* or the elongated hole 40*b'*. Thus, in FIG. 6*a*, the elongated hole 40*b"* of catch 7" (identified by "r.") constitutes a gliding guide for the bolt 2' which securely compensates for production and assembly tolerances when the window lifter is actuated.

Figure 6A:
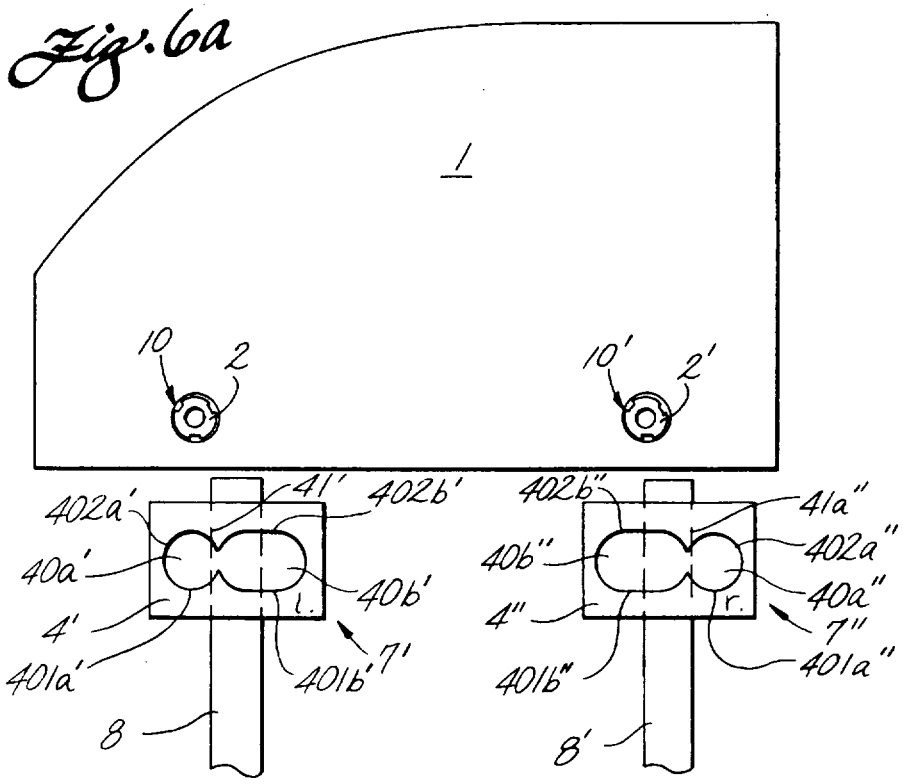
FIG. 6*a* is a schematic representation of a catch with retaining legs corresponding to FIG. 5 used in connection with a dual-strand wire window lifter wherein the window is for the door on the driver's side and the circular holes point outward.
Figure 6B:
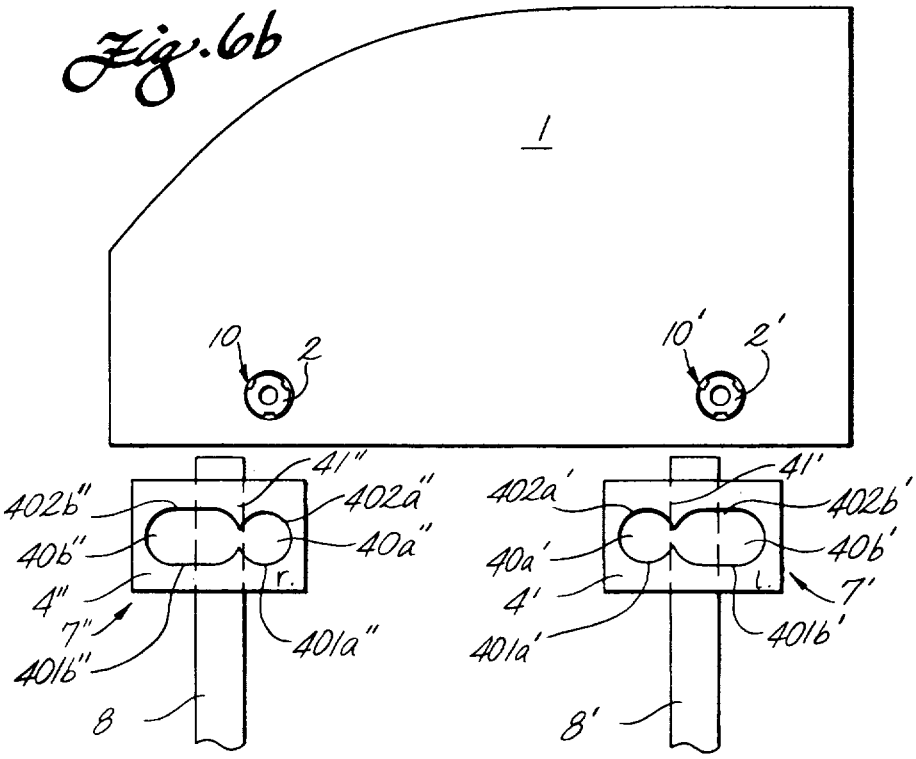
FIG. 6*b* is a schematic representation of a catch with retaining legs corresponding to FIG. 5 used in connection with a dual-strand wire window lifter wherein the window is for the door on the driver's side and the circular holes point inward.
Figure 6C:
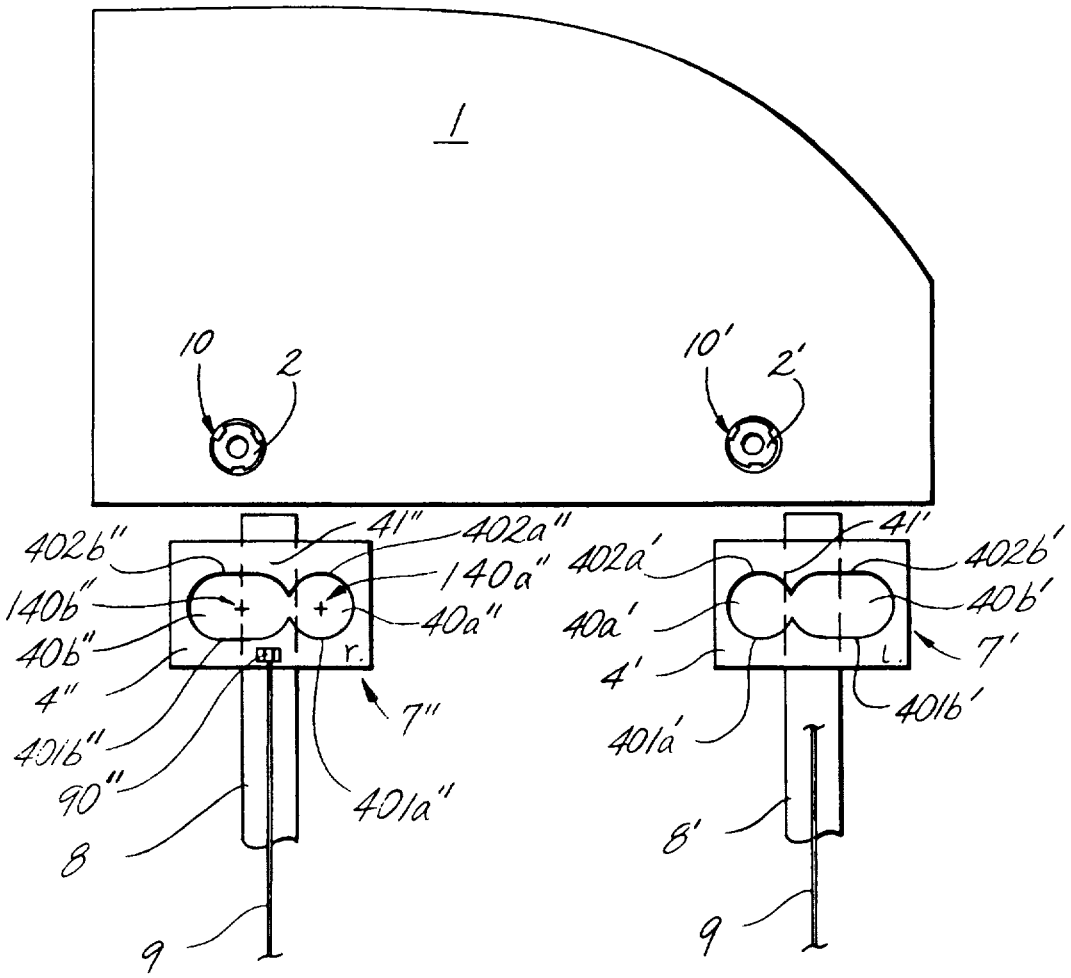
FIG. 6*c* is a schematic representation of a catch with retaining legs corresponding to FIG. 5 used in connection with a dual-strand wire window lifter wherein the window is for the door on the passenger side and the circular holes point inward.

In schematic representations, FIGS. 6*a* to 6*c* show different variants of the combination of so-called right catches 7" (further identified by "r.") and left catches 7' (further identified by "l.") in the right and left doors. Since the guidance length of the front portion of the window adjacent the A pillar is often very short, it is useful to realize the window guidance on this side via the circular hole 40*a'* of the catch. Alternatively, the tolerance compensation is provided by means of the elongated hole 40*b"* on the rear portion of the window closer to the B pillar.

In accordance with FIG. 6*a*, which schematically illustrates the association of retaining legs 4',4" of the catches 7',7" guided on guide rails 8,8' of a dual-strand cable window lifter with the bolts 2, 2' seated in the through holes 10, 10' of a window 1, the circular holes 40*a'*, 40*a"* of the retaining legs 4',4" are outwardly oriented. In this case, the circular hole 40*a'* of the retaining legs 4' of catch 7' is associated with the bolt 2 located on the front portion of the window. In contrast, the retaining leg 4" closer to the B pillar is positioned such that the associated bolt 2' is locked into the elongated hole 40*b"* when being clipped in and is slidingly guided therein transversely to the path of the window 1 for the purpose of tolerance compensation.

FIG. 6*b* only differs from the representation corresponding to FIG. 6*a* in that the circular holes 40*a'*, 40*a"* of the retaining legs 4',4" point inward.

Assuming that in the schematic representations of FIGS. 6*a* to 6*c* the window lifters are inwardly located ones, i.e. disposed between the window 1 and the interior door paneling, the windows in accordance with FIG. 6*a* and 6*b* are to be assigned to a door on the driver's side and the window in accordance with FIG. 6*c* to a door on the passenger side.

In a comparison of FIGS. 6*b* and 6*c*, both of which have retaining legs with inwardly oriented circular holes 40*a'*, 40*a"*, it can be readily seen that by interchanging right catches 7" (identified by "r.") and left catches 7' (identified by "l.") of the present invention, i.e. by their multiple applicability at different guide rails 8, 8' of the door on the driver's side or the passenger's side, the number of variants of the present invention to fasten a window to a guide device is reduced.

Referring to FIG. 6*c*, cable 9 has additionally been indicated to better illustrate the function of a window lifter system fastened by the present invention. FIG. 6*c* schematically illustrates communication and interrelation of parts in a window lifter system as disclosed in German Patent Publications DE 32 01 098 C2 and in DE 33 27 295 C2, the disclosures of which are fully incorporated herein by reference. In particular, the cable 9 forms a closed loop and is driven by an electromotor for lifting and lowering window 1. Furthermore, catch 7' is guided by guide rail 8' and catch 7" is guided by guide rail 8. Guide rails 8,8' are located in the motor vehicle door. Since window 1 is fastened to catch 7' and catch 7", window 1 is lifted or lowered by lifting or lowering catches 7",7' guided in guide rails 8,8'. Cable 9 is connected to catch 7" through nipple chamber 90" via a cable nipple. In the same way, cable 9 is connected to catch 7'.

More particularly, referring to catch 7" (identified by "r"), the point of application of the force of the window 1 is located on the catch 7" (via the nipple chamber 90") preferably in the middle between the center points 140*a"*, 140*b"* of the cutouts 40*a"*, 40*b"*. By this means, an unnecessarily large breakdown torque on the catches, caused by the window weight, is prevented.

The disclosures of German patent applications—P 43 25 917.0, filed on Aug. 2, 1993 and P 44 23 440.6 filed on Jul. 5, 1994, copies of which accompany this application, are incorporated fully herein by reference. Priority of these German applications is claimed.

While the invention has been described and illustrated herein with reference to a preferred embodiments thereof, it will be understood that various changes in form and details may be made without substantially diverging from the spirit and scope of the invention.

What is claimed is:

1. A device comprising a pair of retaining legs and at least one connecting element for fastening a window of a motor vehicle in a guide device of a window lifting system, the pair of retaining legs being displaced apart to allow the insertion of a window between the pair of retaining legs, at least one retaining leg of the pair of retaining legs comprising an opening therein for receiving the connecting element; and the at least one connecting element being adapted to be coupled to the window prior to the insertion of the window between the pair of retaining legs, and upon such insertion to engage the at least one retaining leg in the opening in a fastened state.

2. The device of claim 1, wherein the at least one connecting element is a bolt, the bolt being adapted to be disposed through a hole in the window and being equipped with one or more stays on an outside circumference of the bolt that prevents the bolt from becoming dislodged from the hole.

3. The device of claim 2 wherein an edge of the bolt inserted into the hole is beveled to facilitate the insertion of the bolt into the hole.

4. The device of claim 2 wherein the bolt is a plastic bolt.

5. The device of claim 1 wherein the at least one connecting element is glued to a surface of the window.

6. The device of claim 1 wherein the at least one connecting element is formed as part of the window.

7. The device of claim 1 wherein the at least one connecting element is comprised of a bolt with a hollow center and a peg that is inserted into the hollow center.

8. The device of claim 7 wherein the bolt has a slit that runs longitudinally along the outside edge of the bolt.

9. The device of claim 8 wherein the slit in the bolt is expanded to conform the cross sectional area of the bolt to the circumference of a hole in the window through which the bolt is disposed when the peg is inserted into the hollow center of the bolt.

10. The device of claim 7 wherein the peg has a slit that runs longitudinally along the outside edge of the peg, the slit of the peg being adapted to contract to conform the cross sectional area of the peg to the circumference of the hollow center of the bolt.

11. The device of claim 7 wherein an edge of the bolt that is inserted into a hole of the window through which the bolt is disposed is beveled to facilitate the insertion of the bolt into the window.

12. The device of claim 7 wherein an edge of the peg that is inserted into the hollow center of the bolt is beveled to facilitate the insertion of the peg into the hollow center of the bolt.

13. The device of claim 1 wherein an upper horizontal edge of the at least one retaining leg is rounded and sloped down and inward as a guide for the insertion of a lower edge of the window between the retaining legs of the retaining leg pair.

14. The device of claim 1 wherein the at least one retaining leg further comprises a clip that flexes to allow the at least one connecting element to be inserted between the clip and the opening of the at least one retaining leg.

15. The device of claim 1 wherein the at least one retaining leg facing the window which comprises the opening has an inside surface which comprises a recessed generally vertical channel, the vertical channel being wider at one end of the at least one retaining leg and becoming progressively smaller toward the opening of the at least one retaining leg.

16. The device of claim 15 wherein the vertical channel becomes a part of the opening at its smaller end.

17. The device of claim 1 wherein the at least one connecting element comprises a first connecting element disposed on one side of the window and a second connecting element disposed on the other side of the window, and where each of the retaining legs of the retaining leg pair comprise an opening one for receiving the first connecting element and the other for receiving the second connecting element.

18. The device of claim 17 wherein an upper horizontal edge of each retaining leg of the retaining leg pair is tapered inward as a guide for the insertion of a lower edge of the window between the retaining legs of the retaining leg pair.

19. The device of claim 17 wherein each retaining leg of the retaining leg pair has a recessed vertical channel on an inside surface of the retaining legs facing the window, each vertical channel being wider at one end of the channel and becoming progressively smaller toward the opening of the respective retaining leg.

20. The device of claim 19 wherein the vertical channel becomes a part of the opening of the corresponding retaining leg.

21. The device of claim 17 wherein a first retaining leg of the pair includes a clip that flexes to allow the first connecting element to be inserted between the clip and the opening of the first retaining leg.

22. The device of claim 17 wherein a second retaining leg of the pair includes a clip that flexes to allow the second connecting element to be inserted between the clip and the opening of the second retaining leg.

23. The device of claim 1 wherein the opening of the at least one retaining leg is extendable horizontally to compensate for dimensional variances of the connected element and extendable vertically to position the window.

24. The device of claim 23 wherein the opening is oblong.

25. The device of claim 1 wherein the displacement between the two legs of the retaining leg pair is substantially equal to the thickness of the window.

26. The device of claim 1, wherein the fastening device and the guide device of the window lifter system are one piece.

27. The device of claim 1 wherein the opening of the at least one retaining leg comprises two cutouts, a first cutout and a second cutout, disposed adjacent to each other.

28. The device of claim 27 wherein the at least one retaining leg further comprises a clip that flexes to allow the at least one connecting element to be inserted between the clip and one of the two cutouts of the at least one retaining leg.

29. The device of claim 27 wherein the first cutout is disposed adjacent to and to the left of the second cutout.

30. The device of claim 27 wherein the first cutout is disposed adjacent to and to the right of the second cutout.

31. The device of claim 27 wherein the first cutout comprises a substantially circular cutout and the second cutout comprises a horizontally directed elongated cutout.

32. The device of claim 31 wherein the two cutouts are connected by a gap.

33. The device of claim 31 wherein the at least one retaining leg further comprises a clip that flexes to allow the at least one connecting element to be inserted between the clip and the substantially circular cutout of the at least one retaining leg.

34. The device of claim 31 wherein the at least one retaining leg further comprises a clip that flexes to allow the at least one connecting element to be inserted between the clip and the horizontally directed elongated cutout of the at least one retaining leg.

35. The device of claim 27 wherein each of the two cutouts have respective center points and wherein a point of application of force created by the window on the device is substantially in the middle of the respective center points.

36. The device of claim 35 wherein the application point of the force of the window is a nipple.

* * * * *